US007201445B1

(12) United States Patent
Dubiel et al.

(10) Patent No.: US 7,201,445 B1
(45) Date of Patent: Apr. 10, 2007

(54) FEEDING SEAT

(75) Inventors: David Dubiel, Goffstown, NH (US); Stanley Thompson, New Boston, NH (US)

(73) Assignee: Optilife Products, Inc., Goffstown, NH (US)

( * ) Notice: Subject to any disclaimer, the term of this patent is extended or adjusted under 35 U.S.C. 154(b) by 0 days.

(21) Appl. No.: 11/441,710

(22) Filed: May 26, 2006

(51) Int. Cl.
*A47D 1/00* (2006.01)

(52) U.S. Cl. ..... 297/256.13; 297/153; 297/329

(58) Field of Classification Search ..... 297/153, 297/250.1, 256.1, 256.13, 256.15, 325, 329
See application file for complete search history.

(56) References Cited

U.S. PATENT DOCUMENTS 825,984 A * 7/1906 Schmersahl ..... 297/91
1,739,366 A 12/1929 Lang
2,549,902 A * 4/1951 Hibbard et al. ..... 297/284.3
2,695,654 A * 11/1954 Boyd ..... 297/423.26
4,547,017 A * 10/1985 Lescure ..... 297/318
4,586,747 A 5/1986 Taylor
4,603,903 A 8/1986 Moscovitch
4,762,364 A * 8/1988 Young ..... 297/256.12
4,790,599 A * 12/1988 Goldman ..... 297/327
4,854,638 A 8/1989 Marcus et al.
D314,674 S 2/1991 Kohus et al.
5,092,004 A 3/1992 Cone et al.
5,155,871 A 10/1992 Sams
D330,842 S 11/1992 Meeker et al.
5,346,279 A * 9/1994 Pecorella ..... 297/256.1
5,380,062 A 1/1995 Nania
5,415,475 A 5/1995 Sandy
5,474,355 A 12/1995 Lerner et al.
5,551,751 A 9/1996 Sedlack et al.
D383,911 S 9/1997 Conforti et al.
6,033,019 A 3/2000 Hession-Kuna et al.
D424,312 S 5/2000 Hotaling et al.
6,082,814 A * 7/2000 Celestina-Krevh et al. . 297/118
6,428,099 B1 8/2002 Kain
6,454,350 B1 9/2002 Celestina-Krevh et al.
6,773,060 B2 * 8/2004 Sher et al. ..... 297/188.14
2003/0102702 A1 6/2003 Daley et al.
2003/0151285 A1 8/2003 Keegan et al.

* cited by examiner

*Primary Examiner*—Peter R. Brown
(74) *Attorney, Agent, or Firm*—Davis Bujold & Daniels, P.L.L.C.

(57) ABSTRACT

A booster seat for children and infants and more particularly an improved feeding seat with telescoping and retractable arms extending from a base supporting a removable tray to facilitate feeding of a child. The feeding seat is reclinable and also foldable into a compact transportable unit separately from the removable tray for efficient use and compact storage and transport.

18 Claims, 12 Drawing Sheets

FEEDING SEAT

FIELD OF THE INVENTION

This invention relates to seats for supporting children and more particularly to a new and improved booster seat which will also function as a feeding seat with telescoping and retractable arms supporting a removable tray to facilitate feeding of a child. The feeding seat is also foldable for efficient and compact storage and transport.

BACKGROUND OF THE INVENTION

A number of improvements have been made in the booster seat art in recent years. Early booster seats had a fixed seat and, therefore, were not adjustable for either the size of the child or a preferred seating orientation. Generally, such seats were designed only for use as a booster seat. More recently, improvements have been made in the field which have made the seats adjustable not only in seat height, but also reclinable so that they may accommodate very small children as well as to accommodate the preferred feeding position of a maturing child, and they have been made more versatile by providing them with trays which enable the booster seats to function as feeding chairs.

U.S. Pat. No. 4,854,638 shows such a booster seat wherein the back rest and seat panel may be moved back and forth, and up and down respectively, and the assembly includes a detachable tray. Another booster seat found in the prior art has an invertible seat panel which allows the seating surface to be raised or lowered depending upon which seating surface is utilized. That arrangement is shown in U.S. Pat. No. 4,586,747. Other prior art patents that show children's seats that are collapsible, such as U.S. Pat. Nos. 1,739,366 and 4,603,903, while other adjustable child's seats are shown in U.S. Pat. Nos. D330,842 and D314,674.

U.S. Pat. No. 6,033,019 and U.S. Pat. No. D424,312 disclose a tiltable seat for holding a child and a removable feeding tray. A back portion of the seat is joined to a bottom portion, which is supported on a base, and the seat has a number of selectable height adjustment positions relative to the back portion of the seat. A series of selectable tilt positions are also provided for the back and seat portion relative to the base. The feeding tray is adapted to be removably attached to both of the side arms of the seat frame and tilts in angular orientation cooperatively with the arms of the seat to which it is attached. This arrangement is an issue, because of the limited adjustment mechanism between the seat and the feeding tray. While in and out adjustment of the feeding tray, relative to the seat back, can be accomplished, it is difficult if not impossible to maintain the tray in a flat, horizontal orientation relative to the ground as the seat tilts. Although the base includes a pair of spaced apart slots for receiving a strap to secure the seat to a support, such as a chair, this seat is not easily transported since the seat comes apart in several large pieces, which are not foldable, and thus difficult to transport and store.

Similarly, published U.S. Patent Application No. 2003/0151285 A1 discloses a seat which tilts on top of a base and which is also height adjustable relative thereto. The removable tray, which is adjustable in and out relative to the seat via a number of fixed notches in the seat, is provided with only one pair of notches that permits angular adjustment of the tray relative to the seat and thus, in many instances, the tray cannot be aligned horizontal or flat relative to the ground. Again, this seat is bulky, difficult to transport and severely limited in tray adjustment capabilities.

SUMMARY OF THE INVENTION

Wherefore, it is an object of the present invention to overcome the above mentioned shortcomings and drawbacks associated with the prior art.

The principle object of the present invention is to provide a feeding seat which is adjustable both for the size of the child as well as for a desired angle of orientation of the seat holding the child.

Another important object of the present invention is to provide a collapsible feeding seat which, when collapsed for toting or storage, is a compact package.

A still further object of the invention is to provide a feeding seat having a telescoping tray support which supports the tray independent of the angle of orientation of the adjustable seat.

A yet further object of the present invention is that a single actuator is used to perform both the functions of adjusting the recline angle of the seat and the aspect of folding the seat for storage and travel.

Another object of the present invention is to provide a feeding seat that is relatively inexpensive to manufacture and which, therefore, may be sold for a modest price while providing maximum convenience and versatility to its owner.

To accomplish these and other objects, the feeding seat of the present invention is made up of five major parts, namely, a base, a track, a back member, a seat member and a tray. The back member is pivotally connected to the seat member and are movable between an operative position, wherein they define a seat for a child and a collapsed position wherein the back member is folded down over the seat member. The seat member is supported on a curved track which provides for the seat member to be slid along the track so as to rotate the seat member and back member into a variety of different recline positions.

The base supports the track and the base is also provided with sidewalls extending upwards on either side of the seat member. The sidewalls are provided with a telescoping member, which is extendable out of each respective sidewall, to support and adjust the tray. The tray is removable from the arms and when the feeding seat is collapsed, the tray may be placed back on the arms after the back member has been folded over on top of the seat member. The height of the seat may be adjusted by raising and lowering the height of the track, and the tray may be adjusted towards and away from the infant or child by releasably locking it in one of several positions on the telescoping arms and also by raising and lowering the telescoping members in each sidewall of the base. A conventional strap arrangement may be provided to hold the child in the seat and additional straps may be used to secure the seat to a chair on which it is placed.

The present invention also relates to a feeding seat for facilitating the feeding of an infant or child comprising a base, a track supported on the base, a seat comprising a hingedly connected seat member and back member slidably supported on the track, a pair of extendable arms slidably attached to the base, a removable tray slidably supported on the extendable arms, and wherein the pair of extendable arms and tray are separate and independent from the slidable seat.

The present invention also relates to a feeding seat wherein the track comprises a first pair of concave rails supportably engaging a cooperating second pair of concave rails positioned on the seat permitting the seat to slide along the track and recline relative to the base.

These and other objects and features of the present invention will be better understood and appreciated from the following detailed description of the preferred embodiment thereof, shown in the accompanying drawings.

BRIEF DESCRIPTION OF THE DRAWINGS

The invention will now be described, by way of example, with reference to the accompanying drawings in which.

DETAILED DESCRIPTION OF THE INVENTION

Figure 1A:
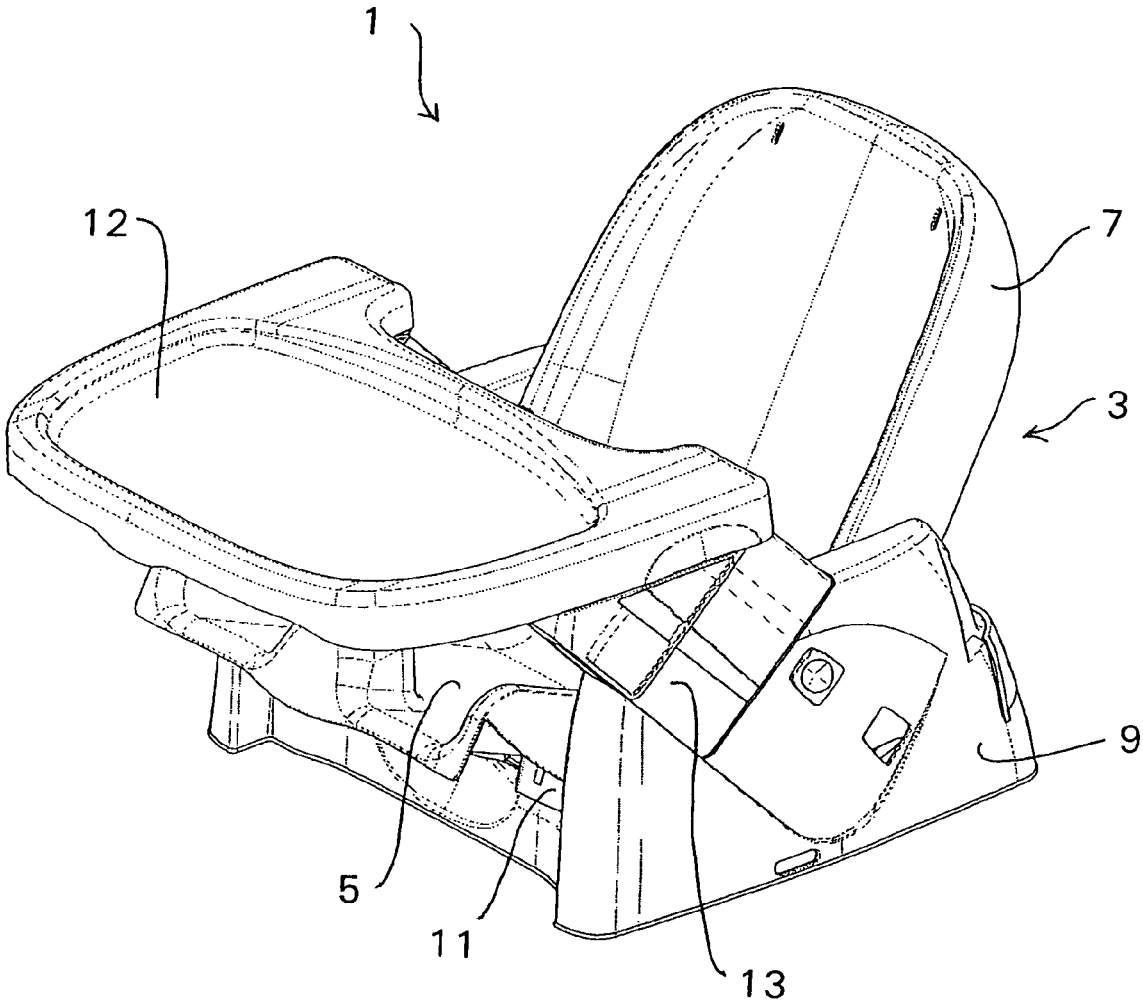
FIG. 1A is a perspective view of a feeding chair of the present invention including the tray in an extended position relative to the base and the seat in a reclined position.

Observing FIG. 1A, a brief description concerning the various components of the present invention will now be briefly discussed. As can be seen in this embodiment, an infant feeding seat 1 is comprised of a number of features, in general, a seat 3 having a seat member 5 and a back member 7 which are hinged together and supported on a base 9. The seat 3 is slidable with respect to the base 9 along a track 11 located underneath the seat member 5. The seat 3 is slidable between an upright position seen in FIG. 1B, and a reclined position as shown by FIG. 1A. A tray 12 is removably supported on a pair of telescoping members 13 extending from the base 9 on either side of the seat 3 to hold food, utensils, etc. Importantly, the tray 12 is supported independently from the seat 3, so that as the seat 3 is slidably rotated between the upright and any desired reclined position, the tray 12 remains substantially immovably fixed to the base 9.

Figure 1B:
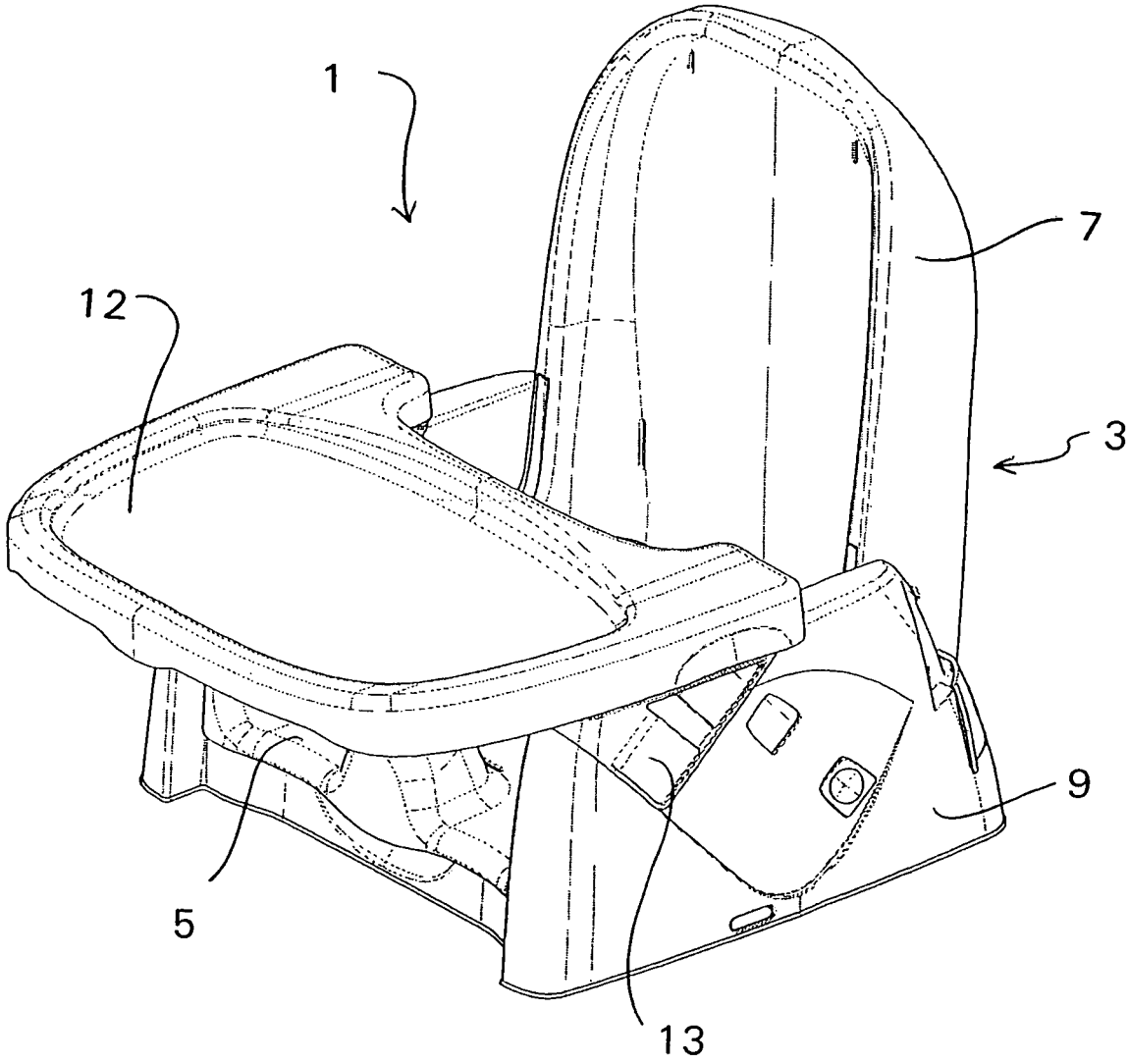
FIG. 1B is a further perspective view of the feeding chair of the present invention with the telescoping arms retracted within the base and the seat positioned in a relatively upright orientation.

The tray 12 is removably attached, usually by a sliding horizontal engagement, to a top portion of both telescoping members 13 and can be adjusted horizontally towards and away from the seat. The telescoping members 13 can be pushed into the base 9 at an angle so as to bring the tray 12 into a desired lower and closer relationship with the seat 3 as seen in FIG. 1B. Alternatively, the telescoping arms 13 may be pulled or extended from the base 9 to raise and distance the tray 12 from the seat 3 as in FIG. 1A. In either event, because the tray 12 is independent of the reclinable seat 3, the tray 12 is constantly maintained level to the ground or floor so that any food or utensils placed on the tray 12 will not slide or fall off the tray 12 when the seat 3 is moved. Consequently, the seat can be adjusted through a full range or reclinability without any necessity to adjust or realign the tray 12.

As noted above, the seat 3 comprises the seat member 5 and the back member 7 which are hinged together by an integral hinge 15 rotatably interlocking the seat member 5 to the back member 7. The hinge 15 is formed by slots 16 in the seat member 5 receiving a corresponding knuckle formed in the back member 7, or vice-versa as best seen in FIG. 3A. In any event, as such an integral hinge 15 could be formed in numerous ways known to those in the art, no further discussion is provided other than the hinge 15 permits the back member 7 to rotate about an approximate 90 degree angle between an operational perpendicular position and a folded storage or travel position as seen in FIGS. 2A and 2B, respectively.

Figure 2A:
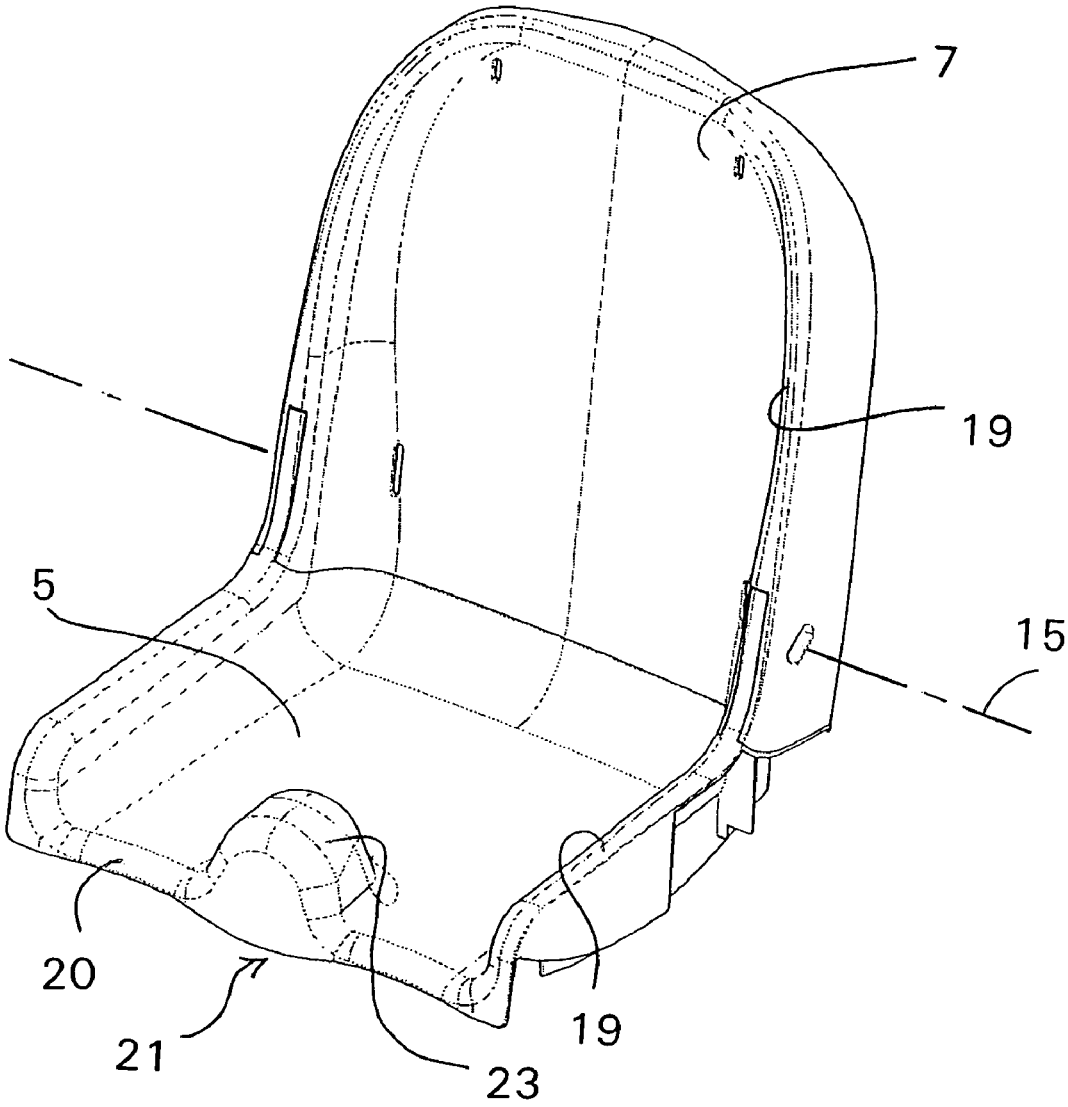
FIG. 2A is a perspective view of the seat including a seat member and a back member connected and hinged in a substantially perpendicular orientation.
Figure 2B:
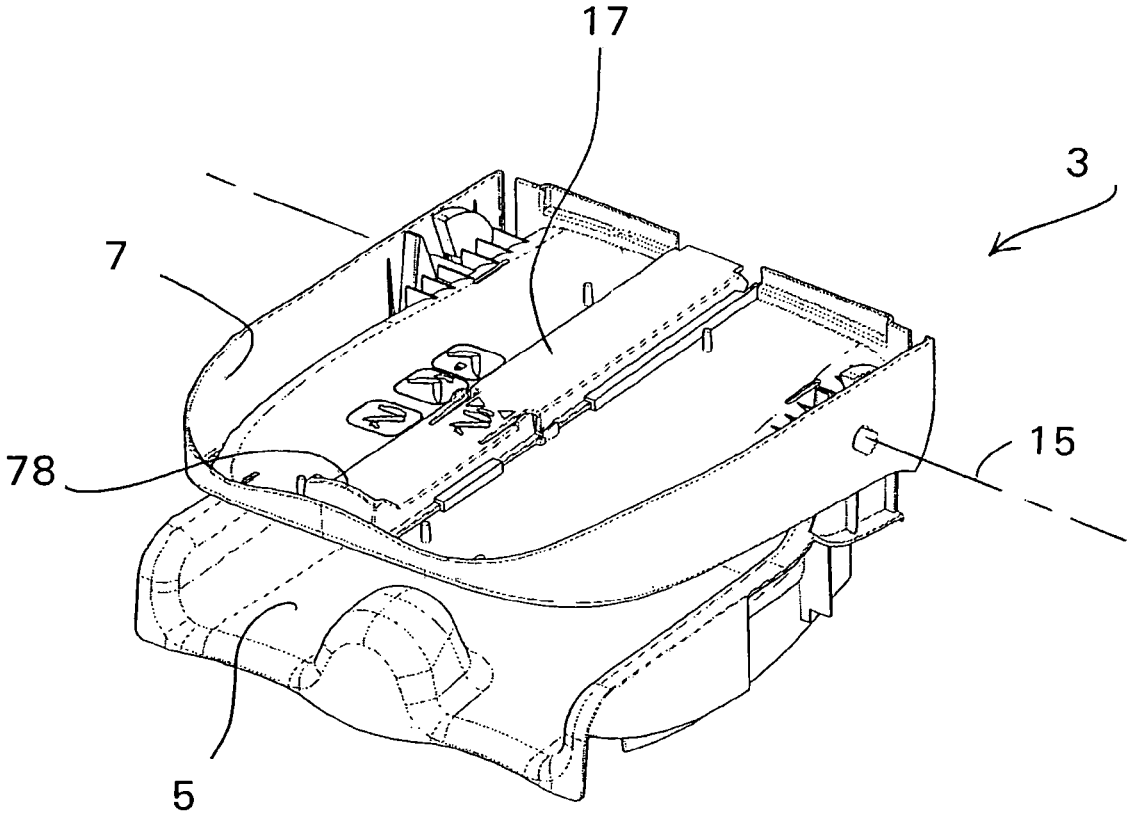
FIG. 2B is a perspective view of the seat with the back member folded over and substantially parallel with the seat member.
Figure 2C:
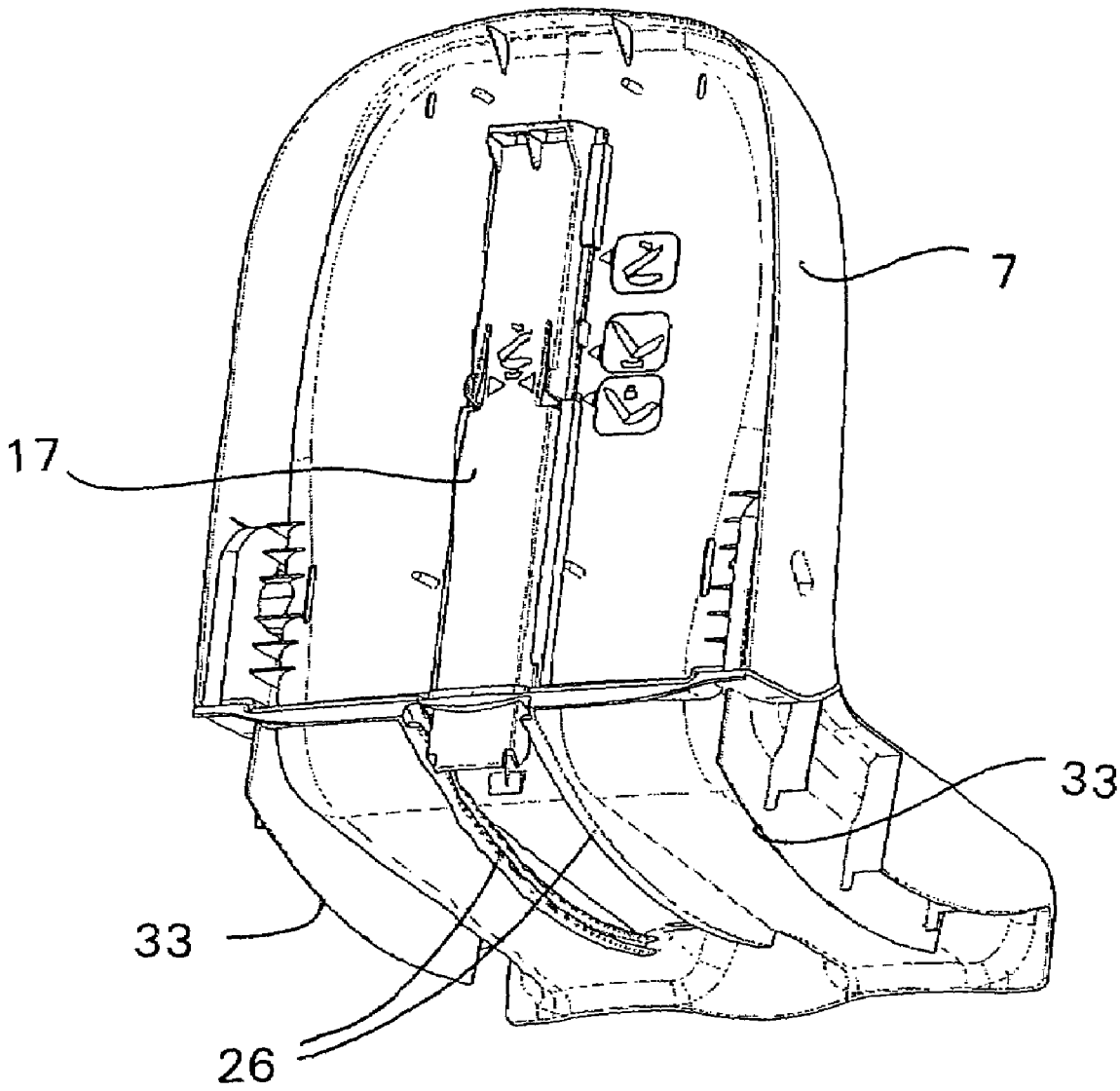
FIG. 2C is a perspective rear and bottom view of the back side and underneath surfaces of the seat member and back member.
Figure 3A:
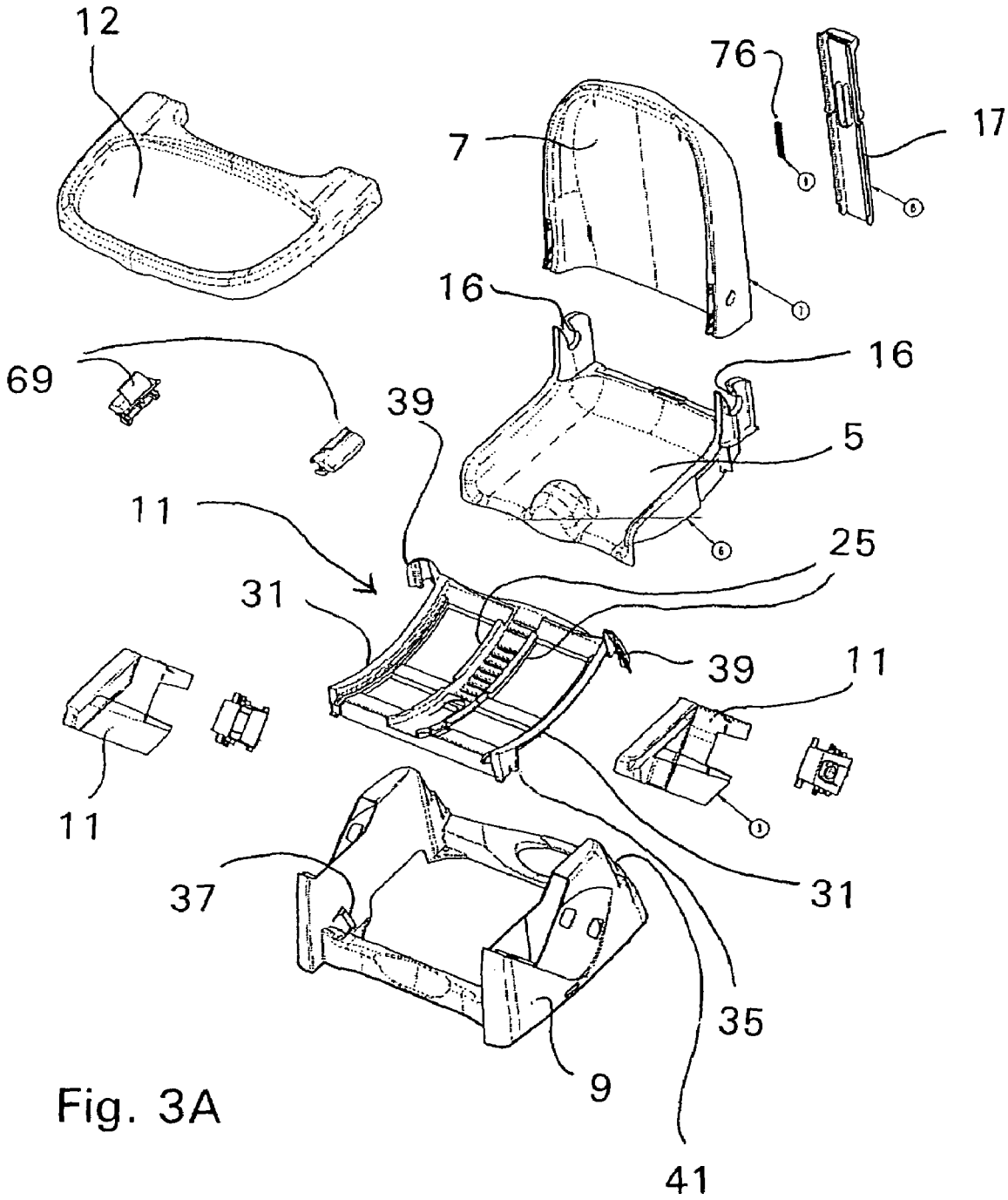
FIG. 3A is an exploded view of the feeding seat of the present invention detailing the individual parts making up the feeding seat.

In the operational position, the back member 7 is rotated about the hinge 15 to a position wherein the back member 7 and the seat member 5 are substantially perpendicularly aligned as seen in FIG. 2A. An actuator 17, attached to the rear side of the back member 7 as shown in FIG. 2C, is responsible for locking the seat member 5 and back member 7 together into the perpendicular alignment and maintaining the same. When the actuator 17 is appropriately actuated, the back member 7 may be released from the locked engagement with the seat member 5 and rotated about the hinge 15 and into a substantially parallel planar orientation with the seat member 5. A further description of the actuator 17 will be provided below in conjunction with the locking feature of the seat and also with the recline and sliding feature of the present invention.

In the operational position, the back member 7 is extended into a substantially vertical relation, i.e., perpendicular, to the seat member 5, as shown in FIG. 2A, so that an infant or child can sit in the seat 3. Neither the seat member 5 nor the back member 7 has a surface which is entirely flat. A lip 19 is provided around the sides and top of the back member 7 creating an ergonomic back depression shaped surface to accommodate and maintain an infant's or child's back comfortably therein. Similarly, the sides of the seat member 5 are provided with a raised lip 19 so as to maintain a childs' legs and hips within the seat member 5. A front edge 21 of the seat member 5 is provided with a down turned lip 20 so that an infants' or childs' legs may comfortably extend or hang over the front edge 21 of the seat member 5.

A raised center pylon 23 may be formed along the front edge 21 of the seat member 5 generally centrally located in order to ensure that a child, whose legs extend on either side of the crotch restraint 23, does not slide bodily forward and out of the seat 3. This crotch restraint 23 may be any height, but is generally in the range of 2–6 inches high and preferably about 3–4 inches high. It is to be appreciated that the surfaces of the seat 3 and back member 7 may be provided with other ergonomic indentations in order to make the seat 3 more comfortable or in better conformance with a human body.

Figure 4:
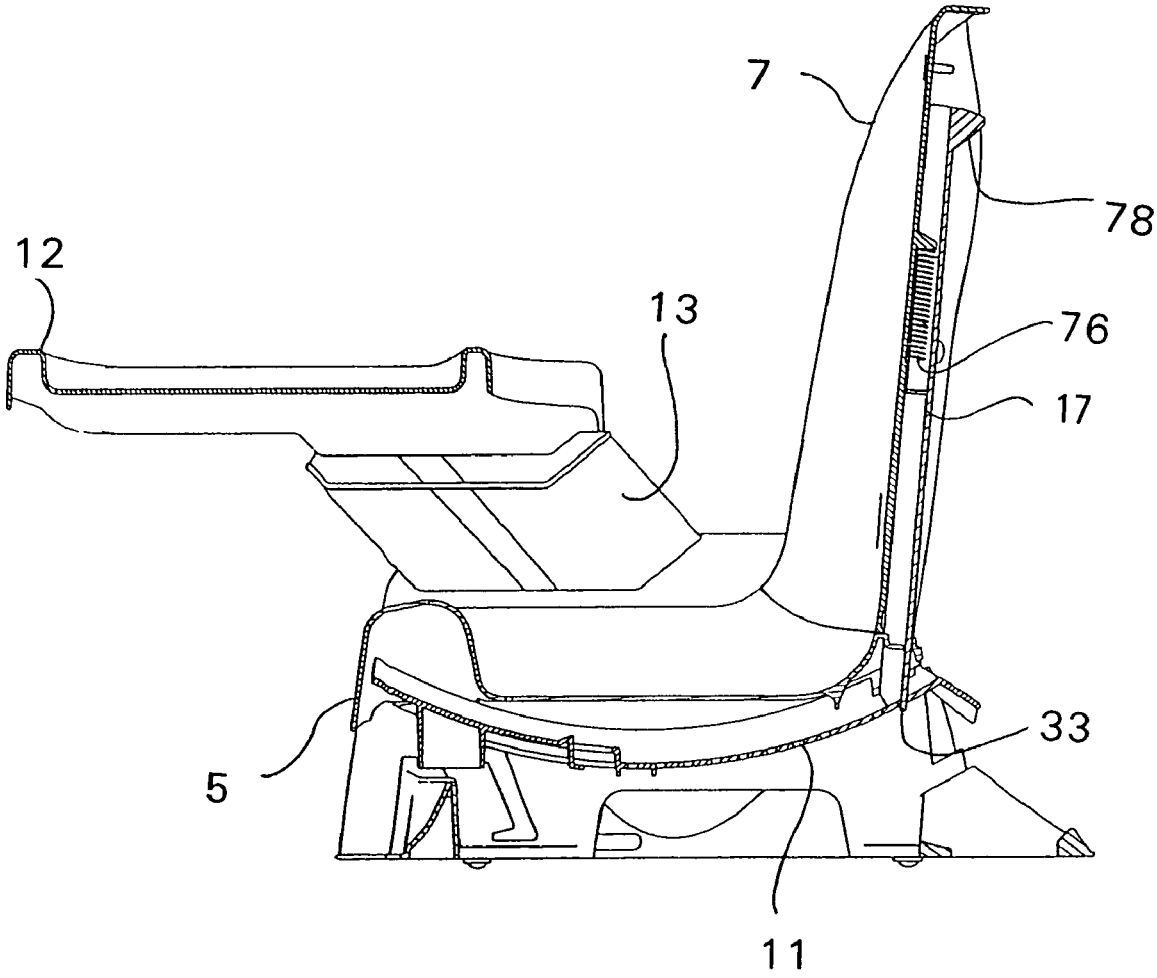
FIG. 4 is a cross-sectional view showing the seat in a substantially upright orientation relative to the base and the tray and telescoping member extended.
Figure 5:
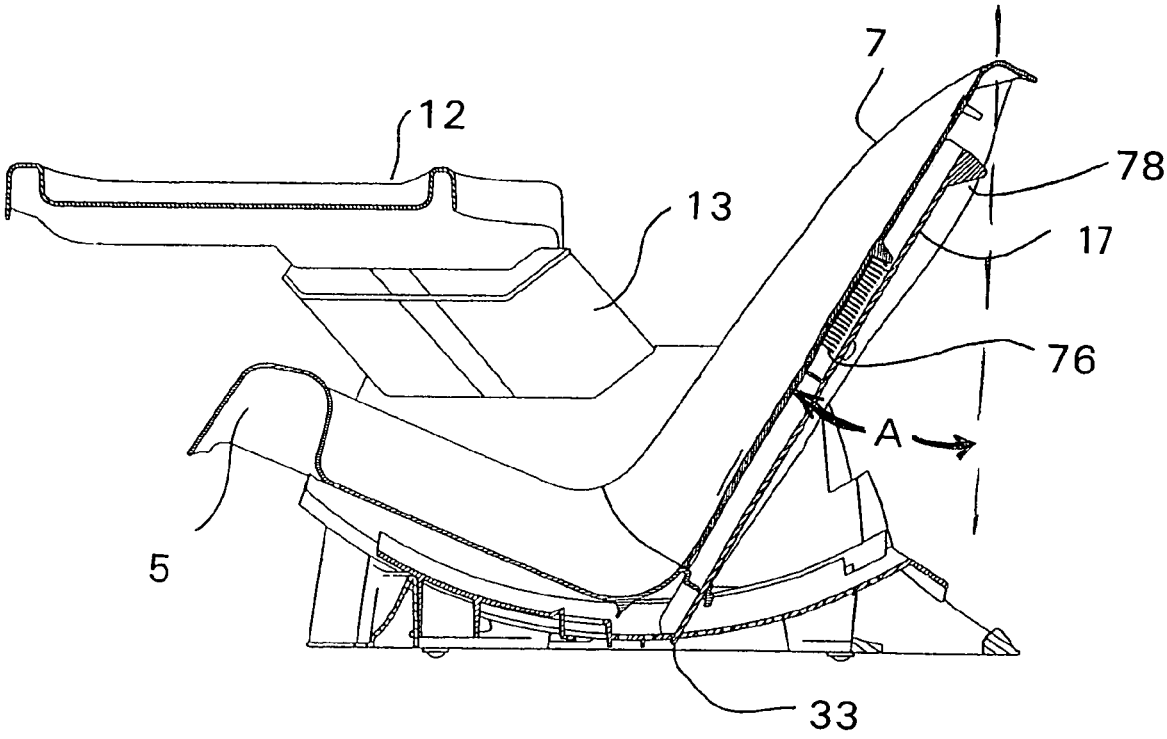
FIG. 5 is a cross-sectional view of the seat in a reclined orientation relative to the base and also with the telescoping member and tray extended.

Turning to FIG. 3A, as best seen in the exploded view, the seat 3 is supported on the base 9 by the downwardly curved, i.e., a concave, track 11 comprising a pair of side rails 25 on either side of a center slot 27 including a series of engagement holes 29 formed therein. The rails 25 on the track 11 interact with a corresponding curved rail engagement portion 26 on an underside of the seat member 5, best seen in FIG. 2C. The rails 25 and rail engagement portions 26 slidably interlock or engage so that the seat 3 is restrained in a side-to-side, i.e., lateral manner, and in a vertical, up and down manner, but the interlocking of the rails 25 with the engagement portions 26 on the underside of the seat member 5 allow for the seat 3 to be slidably rotated along the arcuate length of the track 11. The seat 3 may be slid between a substantially upright position wherein the back member 7 is about vertical, as seen in FIG. 4, and a reclined position, as seen in FIG. 5, wherein the back member 7 is reclined at about a 30–40 degree angle A from the vertical.

Again observing FIG. 3A, the track 11 also has pair of outside edge slots 31 for accepting a mating lower edge 33 of the seat member 5. The edge slots 31 and lower edge 33 are, like the rails 25, concavely curved downward so that the seat member 5 rotatably slides along the outer edge slots 31 when it is maneuvered between recline positions. The track 11 is supported directly by the base 9 in any number of height adjustable positions. A pair of catches 35 is provided on the front of the track 11, which are accepted into respective notches 37 on the front inner wall of the base 9. The catches 35 may be removable from the notches 37 but, in general, are movably fixed therein so as to allow some relative adjustment of the track height relative to the base 9 as discussed in further detail below.

Figure 3B:
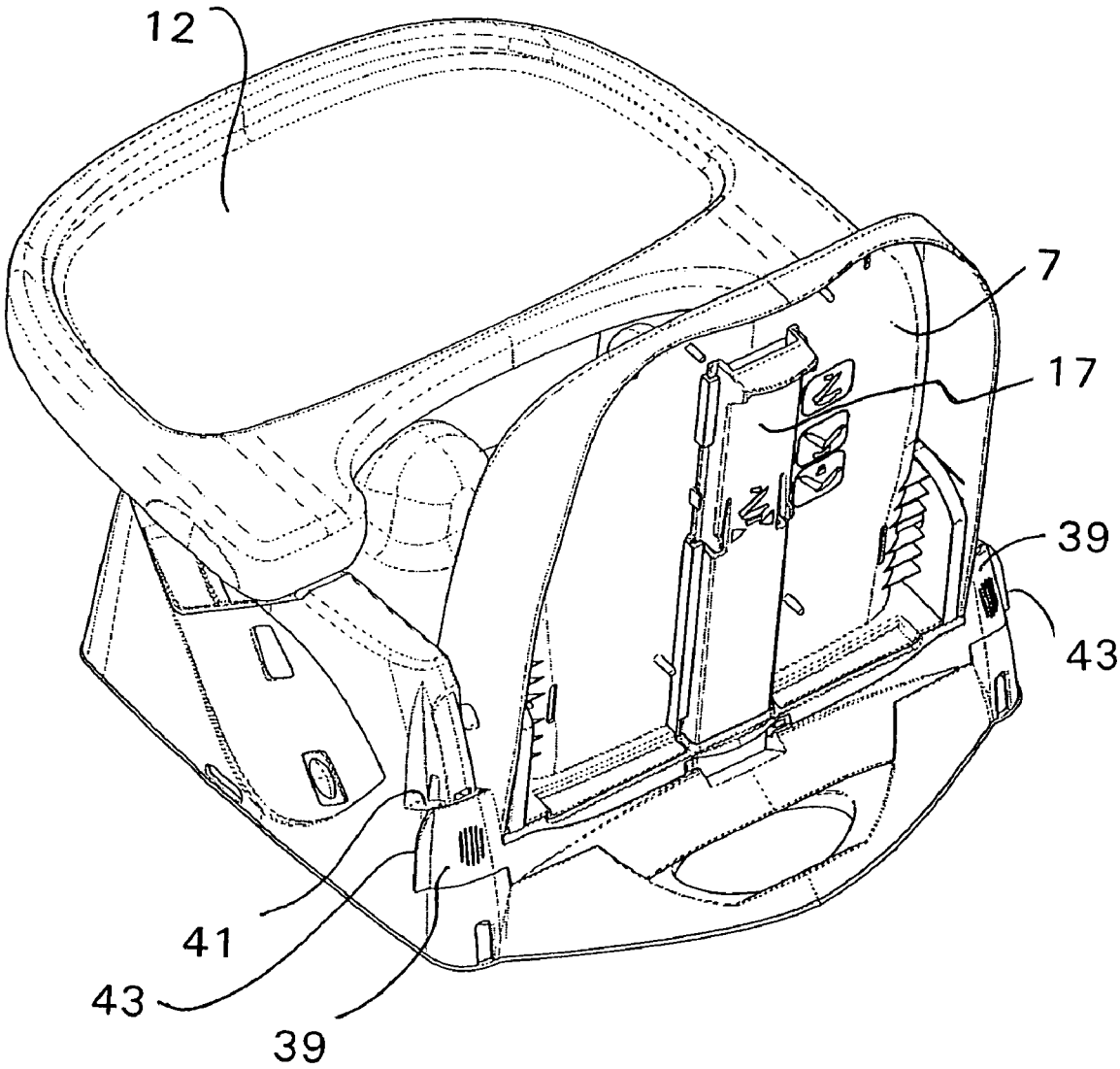
FIG. 3B is a perspective view of the feeding seat from a rear perspective detailing the engagement of the actuator locking the back member to the seat member and the base in a perpendicular relation or orientation relative to the base.

Turning to FIG. 3B, the rear of the track 11 is provided with a pair of opposed locking tabs 39 which engage in a series of ledges 41 formed on a rear edge 49 of the base 9. This permits the track 11 to be adjusted in height, and thus accordingly the seat 3 as well. The locking tabs 39 are biased by their molded shape so as to frictionally engage in a respective ledge 41 formed in the base 9. When a user pulls on the outer edges 43 of the opposing locking tabs 39 on each side of the track 11, the locking tabs 39 can be disengaged from the respective ledges 41 and the track 11 can be raised or lowered so that the locking tabs 39 are brought into engagement with higher or lower located ledges 41 on the base 9.

Figure 6A:
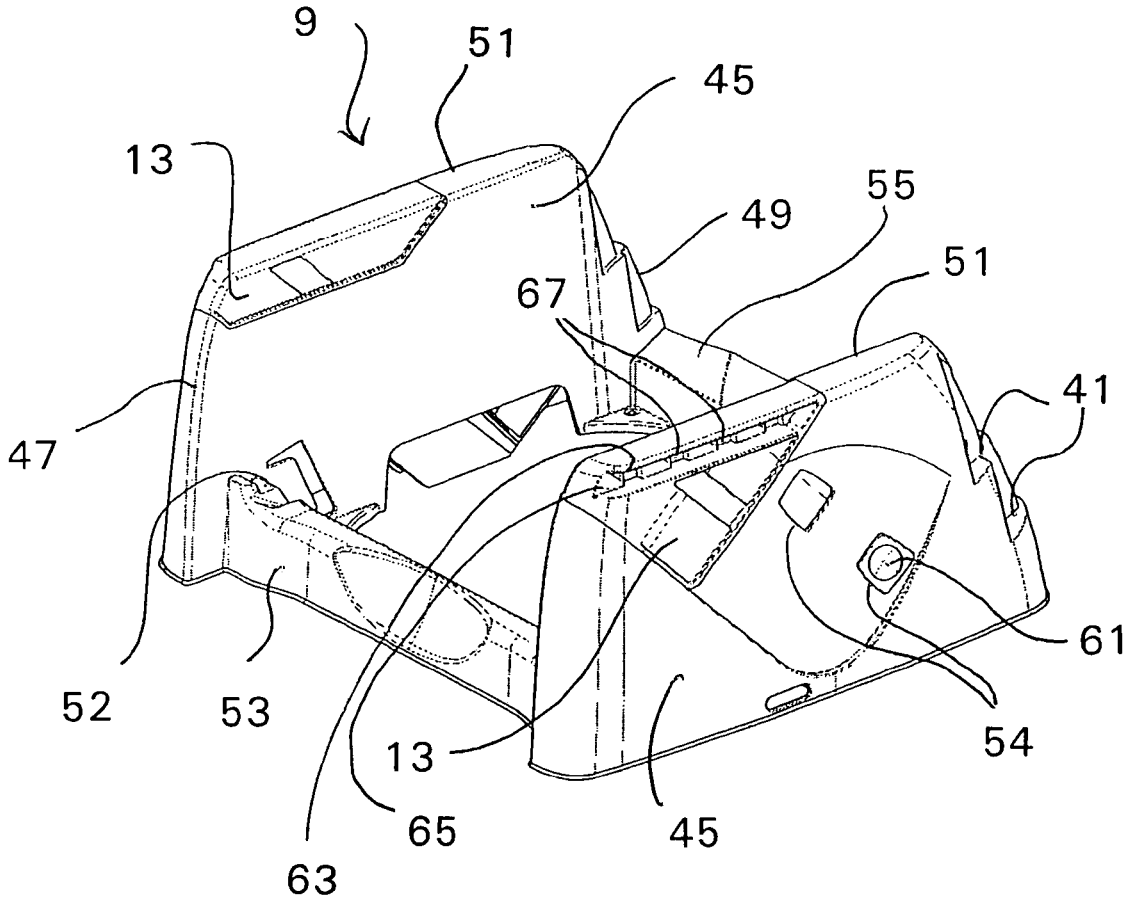
FIG. 6A is a perspective view of the base alone with the telescoping members retracted therein.
Figure 6B:
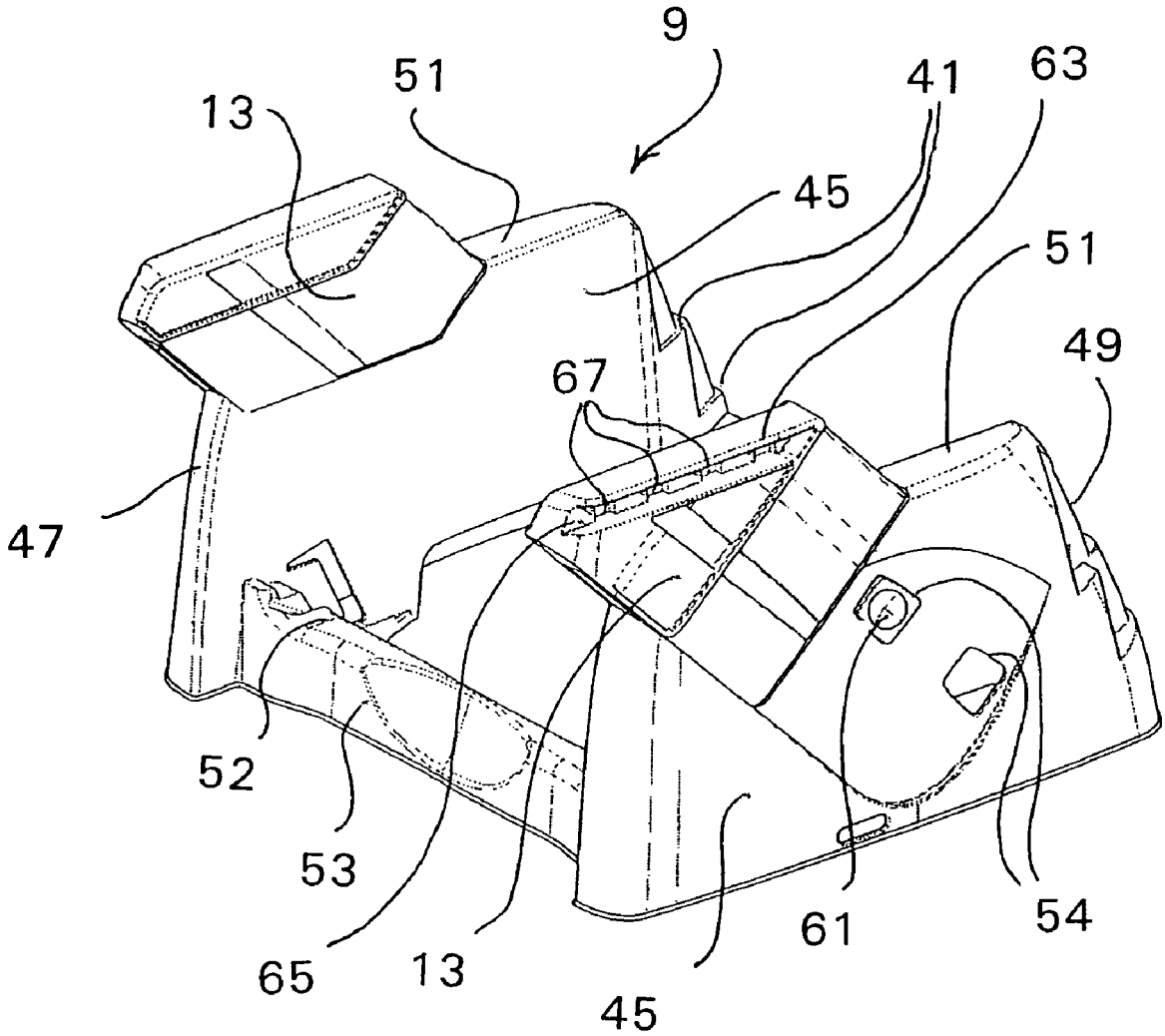
FIG. 6B is a further perspective view of the base having the telescoping members extended therefrom.

FIGS. 6A and 6B show the base 9 of the feeding seat 1 is provided with opposing sidewalls 45 each having a front edge 47, the rear edge 49 and a top arm rest surface 51. The arm rest surface 51 is substantially flat and part of the surface is comprised of a corresponding top surface of the telescoping arm 13 in each sidewall 45. The rear edge 49 of the sidewalls 45 is provided with the series of ledges 41, as discussed above, for engaging the locking tabs 39 and adjusting the height of the track 11 and seat 3. The sidewalls 45 are hollow and each slidably houses the telescoping member 13 inserted therein through an opening formed in the top arm rest surface 51 of the sidewalls.

It is to be noted that the sidewalls 45 of the base 9 are joined by an integral front cross member 53 and a rear cross member 55. The front and rear cross members 53, 55 are connected to and located on a lower portion of the sidewalls 45 and form a portion of the bottom most support surface of the base 9. The front cross member 53 may also be provided with a ledge 52 for receiving and supporting a front edge of the track 11 thereon.

The telescoping arms 13 have a retracted position where the top surface of the telescoping arms 13 are flush with the top arm rest surface 51 of the sidearms, as seen in FIG. 6A. At least a pair of side openings 54 are provided in an outer wall 59 of each sidewall 45 in the base 9 to receive a detent button 61 connected to the telescoping arms 13. With the telescoping arms 13 in the retracted position, the lower side opening 54 is engaged by the detent button 61. As can be appreciated, when the detent button 61 is pressed inwardly, relative to the lower opening 57, the telescoping arms 13 are free to be raised from the retracted position to at least a second extended position wherein the top surface of each telescoping arm 13 is raised above and forward of the sidewalls 45.

At the extended position shown in FIG. 6B, the detent button 61 automatically engages the second higher side opening 54 in the sidewall 45 so as to lock the respective telescoping arm 13 in place. It is to be appreciated that any number of side openings 54 may be provided in the sidewalls 45 to provide substantially different positions to which the telescoping arms 13 extend from the sidewalls 45 of the base 9.

The telescoping arms 13 are further provided with a slide 63 along a top edge for receiving and supporting the tray 12 on the telescoping arms 13. The slide 63 extends substantially the width of the telescoping arm 13 and is defined by a slot 65 in the telescoping arms 13. The slot 65 is provided with a series of spaced apart notches 67 in a base portion of the slot 65 to receive an engagement latch 69 connected to or supported on the tray 12. The latch 69 is spring biased towards the notches 67 so that when the tray 12 is engaged with the telescoping arms 13, the latches 69 can fit securely into a desired notch 67 as thus securing the tray 12 to the telescoping arms 13. The spaced apart notches 67 permit the latches 69 to be adjusted to different horizontal positions relative to the telescoping arms 13 and hence the tray 12 can be slidably adjusted along the top surface of the telescoping arms 13 to either bring the tray 12 closer to the infant or child in the seat 1 or farther away therefrom.

Figure 7:
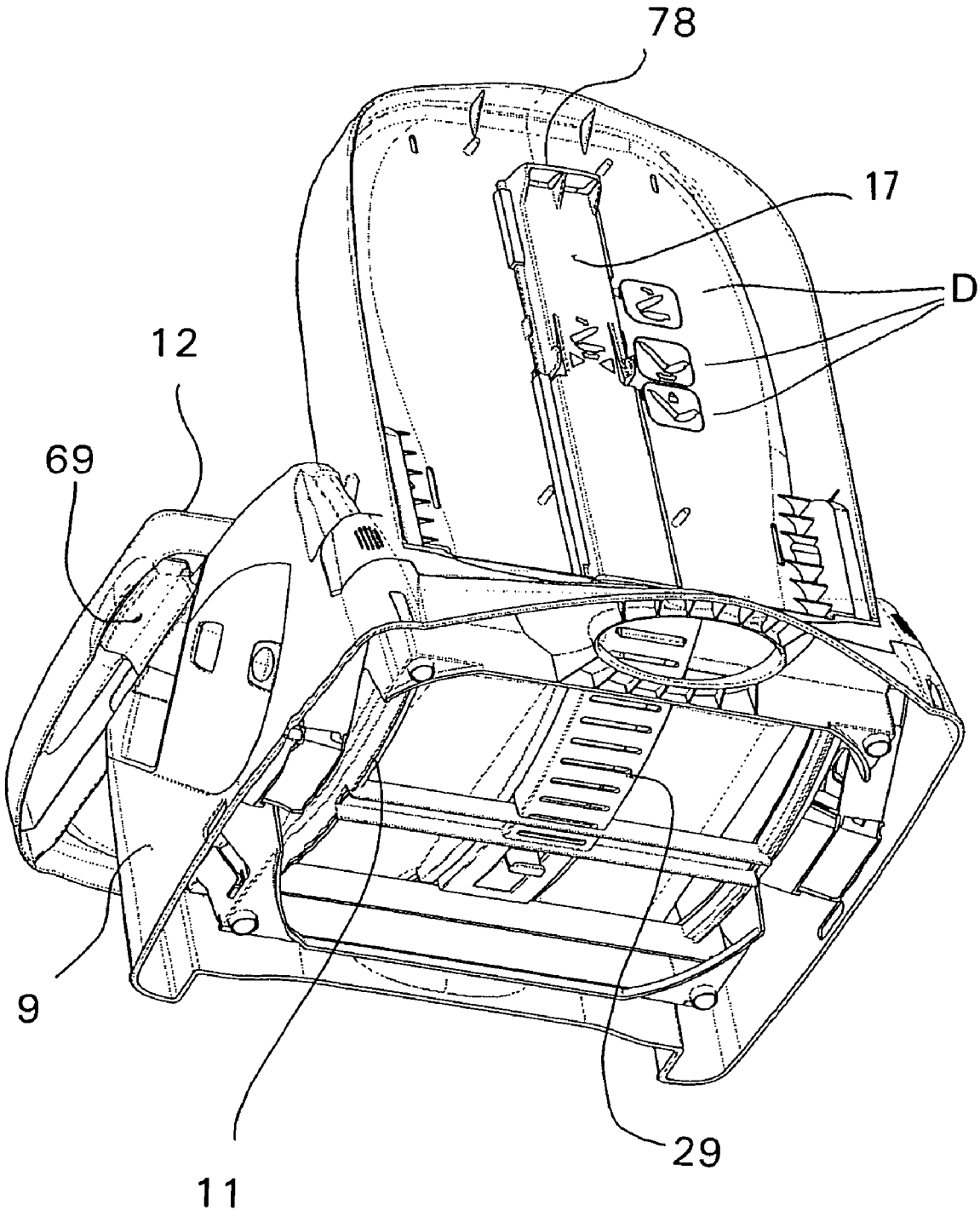
FIG. 7 is a bottom perspective view of the feeding seat detailing the undersides of the tray, track, base and rear surface of the back member.

As seen in FIG. 7, the tray 12 is provided for being supported on the telescoping arms 13, as described above. The tray 12 is removably affixed to the telescoping arms 13, in particular the slide 63, via the latch 69. The latch 69 may be an integral piece or a separate piece connected to an underside of the tray 12 and the latch 69 is springably biased so as to maintain the latch 69 in the desired notches 67 in the slide 63. In order to secure the tray 12 onto the arms, an operator squeezes the latch 69 against the springable bias of the latches 69 on either side of the tray 12 and aligns the tray 12 along the slides 63 both telescoping arms 13 in a desired horizontal position. The tray 12 is secured by the operator releasing the finger lever so that the spring biased latches 69 directly engage the notches 67 in the slide 63. Again, the latch 69 and the notches 67 engaged thereby in the slides 63 of the telescoping arms 13 affixes the tray 12 so that the tray 12 may be moved laterally inwards and outwards, i.e., towards and away from the seat back member 7.

This particular configuration wherein the chair 3 slidably pivots on the base 9 independently from the tray 12, which is separately mounted on the base 9 by way of the telescoping arms 13, as described above, allows the tray 12 to remain in its horizontal position throughout the entire reclining range of the seat 3. This enables the caregiver to utilize the tray surface during feeding in the reclined positions as well as the upright positions even if the seat 3 is moved.

The curved track 11 facilitates the reclining movement of the seat 3 which is supported thereon as well as the raising and lowering of the seat 3 relative to the base 9. The reclining function of the seat 3 is accomplished by actuation of the spring biased actuator 17 as discussed above. Additionally, the spring biased actuator 17 is also responsible for securing the seat 3 in the operational position, and the folding of the seat member 5 and the back member 7 relative to one another for storage or travel. When the spring biased actuator 17 is properly actuated, the back member 7 can be moved from the substantially 90 degree alignment with the seat member 5 to a substantially parallel planar alignment, i.e., folded over and on top of the seat member 5, in order to collapse the seat 3 into a smaller, more compact package for travel purposes.

The reclining positions, as well as the folding feature of the seat member 5 and back member 7 of the above described invention are all facilitated by the single actuator 17 which is slidably affixed to the rear side of the back member 7, as shown in the cross-sections of FIGS. 4 and 5. The actuator 17 is slidably held in a track formed on the rear side of the back member 7. The actuator 17 is also biased by a spring 76 into a downward position wherein a lower edge 33 of the actuator 17 extends downward a desired distance below a lower edge of the back member 7. When the spring bias is to be overcome, an operator merely pulls upward on a handle 78 of the actuator 17 in the direction of arrow U in FIG. 4 and the elongate member is moved upwards relative to the back member 7.

This movement permits two operational states, the first state being the ability to slidably rotate the seat 3 relative to the base 9 and track 11. As can be observed in FIGS. 4 and 5, the very lower end 33 of the actuator 17 extends into and through the engagement holes 29 in the center slot 27 of the track 11. When it is desired to slide the seat 3 along the track 11 relative to the base 9, the operator pulls up a first amount on the handle 78 against the downward bias of the elongate member and the far end of the actuator 17 is retracted from a respective engagement hole 29 in which it was inserted, which frees the seat 3 to be slidable along the track 11 within some range of recline. Once a desired angle of recline is determined by the operator, the operator releases the handle 78 and the spring 76 pushes the actuator 17 and hence the far end 33 thereof into a desired engagement hole 29 in the track 11 so that the seat 3 is held affixed to the track 11.

A second state is attained whereby the actuator 17 permits the back member 7 to be folded over on top of the seat member 5. This happens by the operator pulling up on the handle 78, a second amount generally greater than the first amount to not only retract the far end 33 from the engagement holes 29 in the track 11, but also disengaging the actuator 17 from engagement with the receiving slot in the seat member 5. The different states can be observed in FIG. 7 where on the rear surface of the back member 7 a series of diagrammatic drawings D are shown which instruct the operator to pull up or raise the actuator 17 of the actuator 17 from the locked position to attain either the first state enabling adjustment of the recline angle of the seat or the second state wherein the seat 3 can be folded as described above.

In regards to the interlocking of the seat member 5 and back member 7 into a substantially perpendicular alignment, as seen in FIG. 2C, when in this downwardly biased position, the actuator 17 extends downward and through a receiving hole 75 in the seat member 5. The seat member 5 is thus locked into position by a relatively snug engagement of this receiving hole with the actuator 17.

This arrangement secures the seat member 5 and the back member 7 into the appropriate perpendicular alignment until such time as an operator pulls up on the actuator 17 and releases the actuator 17 from engagement with the receiving hole 75 in the seat member 5. Once this occurs, the seat and back member 5, 7 may be hingedly folded about one another around axis 15 as discussed above.

Returning to FIGS. 4 and 5, which also show the actuator 17 and actuator 17 in cross-section, it is readily apparent that the spring 76 biases the actuator 17 downwards to such an extent that the actuator 17 not only passes through the receiving hole 75 in the seat member 5, but also continues downward to engage the center slot 27 of the track 11. A lower edge 33 of the actuator 17 is further received in one of the engagement holes 29 in the center slot 27 which locks the seat 3 into a desired recline position relative to the track 11 and hence the base 9. As seen in FIG. 4, the actuator 17 is biased by the spring 76 into a rear most engagement hole in the track slot 65 to attain an upright or nearly upright position, and FIG. 5 details the actuator 17 being biased into one of the forward most engagement holes in the track 11 thus the seat 3 attains a more reclined position relative to the base 9. A stop mechanism 77 may be incorporated into the track 11 and seat 3 so that it becomes difficult to over rotate the seat 3 relative to the track 11.

Since certain changes may be made in the above described improved infant and child feeding seat 1 without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A feeding seat for facilitating the feeding of an infant or child comprising:

a base;

a track supported on the base;

a seat comprising a hingedly connected seat member and back member slidably supported on the track;

a pair of extendable arms slidably attached to the base;

a removable tray slidably supported on the extendable arms; and wherein the pair of extendable arms and tray are separate and independent from the slidable seat.

2. The feeding seat according to claim 1, wherein the track comprises a first pair of concave rails supportably engaging a cooperating second pair of concave rails positioned on the seat permitting the seat to slide along the track and recline relative to the base.

3. The feeding seat according to claim 2, wherein the track is further provided with a series of engagement holes for receiving a portion of an actuator attached to the seat in order to secure the seat in a desired reclined orientation relative to the base.

4. The feeding seat according to claim 3, wherein the track further comprises a pair of outer rails for receiving a pair of follower edges on the seat member.

5. The feeding seat according to claim 4, wherein the pair of outer rails on the track are formed concave and parallel with the first pair of concave rails and the pair of follower edges on the seat member are similarly concave.

6. The feeding seat according to claim 1, wherein the hingedly connected seat member and back member rotate between a substantially perpendicular relative orientation defining an operable state of the feeding seat and a substantially parallel orientation defining a storage or travel state of the feeding seat.

7. The feeding seat according to claim 6, wherein a hinge connection between the seat back and seat member is disengageable so that the seat back and seat member can be separated.

8. The feeding seat according to claim 6, wherein an actuator affixes the seat member and back member to one another in the operable state of the feeding seat and releases the seat back and seat member in the storage or travel state of the feeding seat.

9. The feeding seat according to claim 8, wherein the actuator is springably attached to the back member and connects through a receiving slot in the seat member in the operable state to affix the seat member and seat bank in the substantially perpendicular orientation.

10. The feeding seat according to claim 9, wherein the track is further provided with a series of engagement holes for receiving a portion of the actuator attached to the back member in order to secure the seat in a desired reclined orientation relative to the base.

11. The feeding seat according to claim 1, wherein the extendable arms are each angularly supported by the base in order to move the tray in both a vertical and a horizontal direction relative to the seat.

12. The feeding seat according to claim 1, wherein the tray is slidable in a horizontal manner relative to the seat and base along a tray slide formed in each of the extendable arms.

13. A feeding seat for facilitating the feeding of an infant or child comprising:

a base;

a vertically adjustable track supported on the base, the track comprising;

at least a pair of concave rails; and a plurality of engagement slots;

a seat comprising a hingedly connected seat member and back member slidably supported on the track:

an actuator attached to the seat for securing the hingedly connected seat member and back member into a substantially perpendicular orientation and engaging at least one of the plurality of engagement slots in the track;

a pair of arms moveably attached to the base;

a removable tray adjustably supported on the arms; and wherein the pair of arms and tray are adjustable independent of the slidable seat.

14. A feeding seat for facilitating the feeding of an infant or child comprising:

a base comprising;

an arcuate track;

a pair of arms;

a seat comprising a seat member and a back member slidably supported on the arcuate track;

a removable tray adjustably supported on the pair of arms; and wherein the seat is slidably adjustable along the arcuate track independent of the pair of arms and removable tray.

15. The feeding seat for facilitating the feeding of an infant or child according to claim 14 further comprising a hinge connection between the seat member and back member for permitting relative rotation therebetween.

16. The feeding seat for facilitating the feeding of an infant or child according to claim 15, wherein the pair of arms are adjustable relative to the base to adjust the removable tray relative to the seat and back members.

17. The feeding seat for facilitating the feeding of an infant or child according to claim 14, wherein the removable tray is provided with a first position directly adjacent the base and a second position vertically displaced from the base.

18. The feeding seat for facilitating the feeding of an infant or child according to claim 17, wherein the removable tray has a feeding surface maintained in a horizontal alignment in both the first and the second positions.

* * * * *